United States Patent [19]

Boberg

[11] 3,985,180

[45] Oct. 12, 1976

[54] LEAD WEIGHT-MAKING APPARATUS

[75] Inventor: Jarl A. Boberg, Scarborough, Canada

[73] Assignee: A. B. Machine Company, Scarborough, Canada

[22] Filed: Oct. 1, 1975

[21] Appl. No.: 618,684

Related U.S. Application Data

[63] Continuation-in-part of Ser. No. 431,893, Jan. 9, 1974, Pat. No. 3,916,986.

[52] U.S. Cl. ..... 164/332; 214/1 BB; 214/658; 425/126 R

[51] Int. Cl.[2] ..... B22D 17/24; B22D 19/00

[58] Field of Search ..... 425/110, 114, 126; 164/332, 333, 334; 214/1 BB, 1 BT, 658, 8.5 C, 8.5 D

[56] References Cited

UNITED STATES PATENTS

| | | | |
|---|---|---|---|
| 2,781,136 | 2/1957 | Sehn et al. | 214/1 BB |
| 2,840,678 | 6/1958 | Hill et al. | 214/1 BB |
| 2,894,616 | 7/1959 | Young | 214/1 BB |
| 3,013,835 | 12/1961 | Blatt | 214/1 BB |
| 3,151,367 | 10/1964 | De Hart | 164/333 |
| 3,191,246 | 6/1965 | Povell | 425/126 R |

*Primary Examiner*—Ronald J. Shore
*Assistant Examiner*—Carl Rowold
*Attorney, Agent, or Firm*—Sim & McBurney

[57] ABSTRACT

Lead weights for the balancing of automobile wheels are formed in an automatic operation. Molten lead is fed from a bath thereof to a lead weight-forming mold cavity defined by plates in edge abutting relationship and a block located in face abutting relationship with the plates and having a depression formed in the face thereof abutting the plates. The abutting edges of the plates have a groove formed therein extending the depth of the plates and defining a lead conveying passage. A weight retaining clip feed means is provided to feed individual clips from a source thereof to a holding station and clip positioning means is provided for moving individual clips from the holding station to the molding station. The plates include clip support means to support the clips at the molding station. A cutting knife is provided for removing tails from the weights after formation thereof.

27 Claims, 23 Drawing Figures

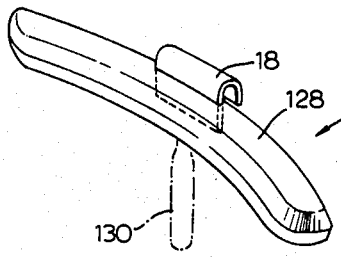
FIG. 11
FIG. 12
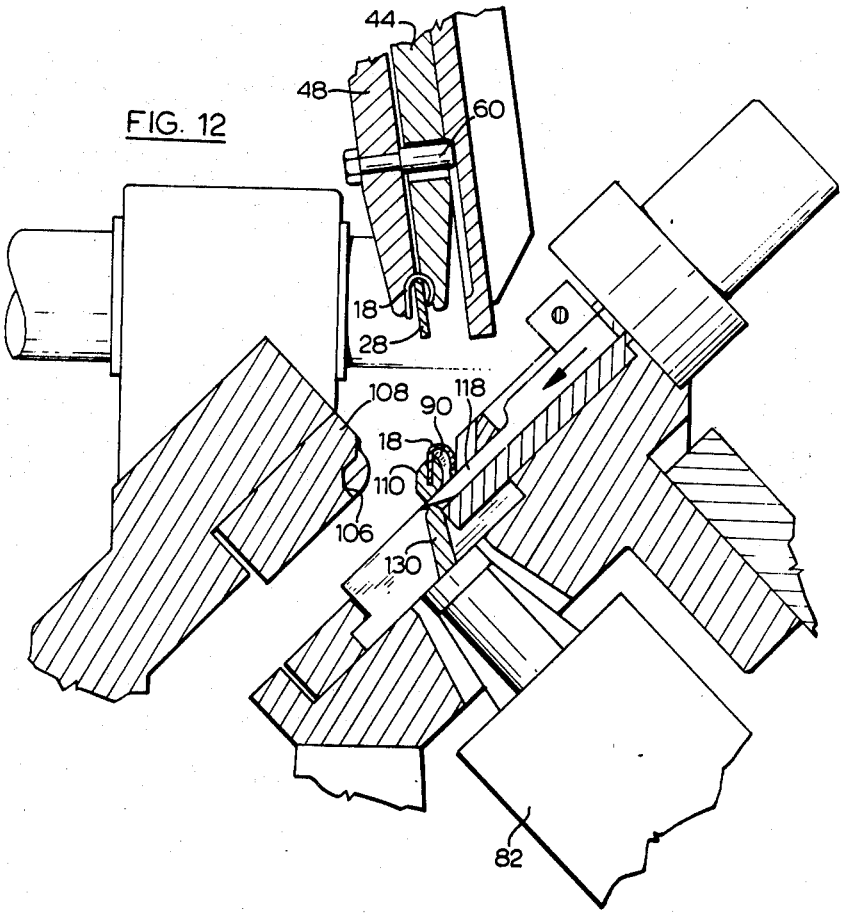

LEAD WEIGHT-MAKING APPARATUS

REFERENCE TO RELATED APPLICATION

This application is a continuation-in-part of application Ser. No. 431,893 filed Jan. 9, 1974 (now U.S. Pat. No. 3,916,986).

FIELD OF INVENTION

This invention relates to the production of lead weights, in particular to apparatus for use in producing lead weights for automobile use.

BACKGROUND OF THE INVENTION

Lead weights are commonly used in balancing automobile wheels, and generally include an arcuately shaped elongated body made of lead, the degree of curvature corresponding to the curvature of the wheel rim, and a clip secured to the body for attaching the weight to the wheel rim.

Lead weights have commonly been made on machines having molds into which molten lead is injected and in which the clip is positioned. Manual procedures are utilized for operation of these apparatus including manual positioning of the clips in the mold and manual closing of the mold. Such procedures are time consuming, and dangerous to the operator due to the proximity of the bath of molten lead to the mold cavity in which the clips are positioned, and residual heat in the weight immediately after formation thereof. The rate of production of these manually operated machines is determined by the speed of the operator, leading to wide variations which may effect production schedules. Further, existing lead weight-making machines suffer from the drawback that the weights have a "tail", corresponding to the cooled lead present after cooling, in the molten lead feed line leading to the mold. The "tails" must be removed after cooling in a separate, time consuming, procedure to provide a useable lead weight

SUMMARY OF THE INVENTION

In accordance with the present invention, there is provided a lead weight-making machine which is able to produce lead weights automatically without the use of manual procedures, and hence is not subject to the vagaries of manual operation, and which eliminates the need to remove tails in a separate step.

BRIEF DESCRIPTION OF DRAWINGS

FIG. 11 is an elevational view of a weight produced by the apparatus of FIG. 1;

FIG. 12 is a part sectional view of the apparatus of FIG. 1 when the tail is cut from the weight;

DESCRIPTION OF PREFERRED EMBODIMENTS

Figure 1:
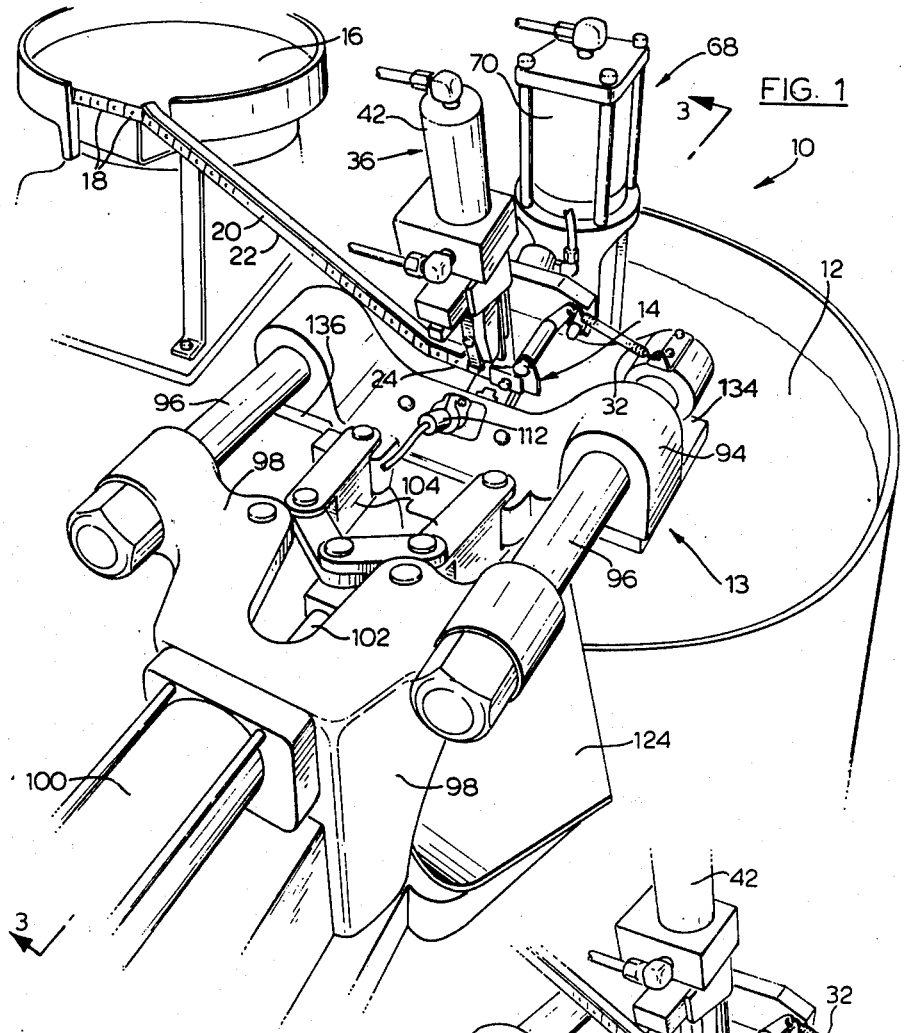
FIG. 1 is an overall perspective view of a lead weight-making machine in accordance with one embodiment of the invention.

Referring first to FIGS. 1 to 13 of the drawings, a lead weight-making apparatus 10 includes a molten bath of lead 12 which is maiintained molten in any convenient manner and weight-making molding equipment 14.

A cylindrical bowl 16 contains a mass of individual clips 18 which are formed into a continuous stream 20 thereof on a downwardly inclined support 22, the downwardly inclined support 22 terminating in a substantially horizontal support 24. A predetermined number of clips 18 is maintained in the stream 20 by use of a suitable sensor (not shown) which actuates the bowl 16 from time to time as required.

Figure 6:
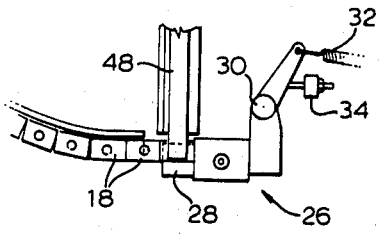
FIG. 6 is an elevational view of the feed clip holder of the apparatus of FIG. 1, when the jaws of the clip positioning portion are as shown in FIG. 4.

The stream 20 of individual clips 18 terminates at a feed station 26 consisting of a support arm 28 which is pivoted at 30 and forming part of the horizontal support 24, the arm 28 normally being biased to the horizontal position shown in FIG. 6 by the action of spring 32 and stop means 34.

A clip positioner 36 includes reciprocably movable jaws 38 which are connected to a piston rod 40 actuated by pneumatic cylinder 42 or any other convenient actuation device. The jaws 38 consist of a first jaw 44 which has a concave inner surface 46 at its lower extremity and a second jaw 48 having a concave inner surface 50 at its lower extremity and opposite the concave inner surface 46. The concave surfaces 46 and 50 cooperate to define a recess normally of substantially the shape and dimension of the clips 18 whereby a clip 18 may be gripped between the jaws 44 and 48.

The second jaw 48 is mounted by pivot pin 52 on the first jaw 44 and the second jaw 48 is biased by a compression spring 54 situated between arms 56 and 58 of the jaws 44 and 48 respectively. The compression spring 54 biases the concave surfaces 46 and 50 of the jaws 44 and 48 towards each other to establish a releasable grip on the clip 18.

A cam follower element 60, in the form of a rod, is secured to the jaw 48 and extends through an opening 62 in the jaw 44 to sit normally in a groove 64 situated in a plate 66 which constitutes with the raised portions at each vertical extremity of the groove 64, a cam for engagement by the cam follower element 60. The plate 66 forms part of the clip positioner 36 and is stationary with respect to the jaws 38. When the rod 60 is located in the groove 64 during vertical movement of the jaws 38, they are in their normal, clip gripping position, which may be described as "closed". However, as may be seen more clearly in FIGS. 4 and 5, in both the lower and upper extremities of the reciprocal travel of the jaws 38, the rod 60 rides up out of the groove 64 at the respective vertical extremity of the groove 64, causing pivotal movement of the jaw 48 relative to jaw 44 against the action of spring 54 thereby moving the concave surfaces 46 and 50 away from each other and out of potential gripping relationship with a clip 18. The latter position may be referred to as "open".

A pump 68 is positioned in the molten bath 12 to pump molten lead from the bath 12 to a mold cavity wherein the weight is formed. The pump 68 may be of any convenient form, actuated by a pneumatic cylinder 70, or any other convenient actuation device, and includes a cavity 72, a one-way valve 74 and a reciprocable plunger 76. As the plunger 76 rises, molten lead is drawn from the molten bath 12 into the cavity 72 throough the one-way valve 74. The molten lead may be ejected from the cavity 72 upon downward movement of the plunger 76, although such ejection cannot occur through the one-way valve 74 since it now is closed. A passageway 78 communicates with the cavity 72 for converging molten lead away from the cavity 72 upon downward movement of the plunger 76. The passageway 78 terminates in an orifice 80.

The passageway 78 may be surrounded by a suitable heating device 82 to maintain the lead in the passageway 78.

The mold cavity to which the molten lead is fed through the passageway 78 is provided by a number of elements. A pair of mold backing plates 84 and 85 is movable towards and away from each other, assuming several positions during such movement, as illustrated generally in FIGS. 8 to 10 and discussed in more detail below.

Figure 10:
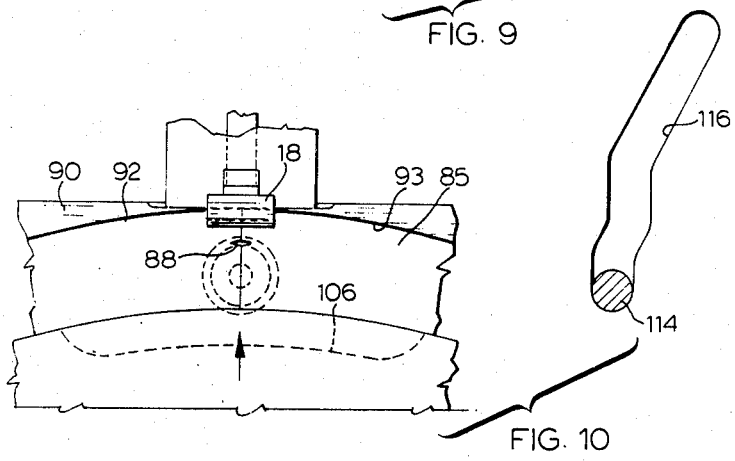
FIG. 10 is an elevational view of the backing plate jaws of the mold in a third position with the corresponding position of the pin in the slot being indicated.
Figure 13:
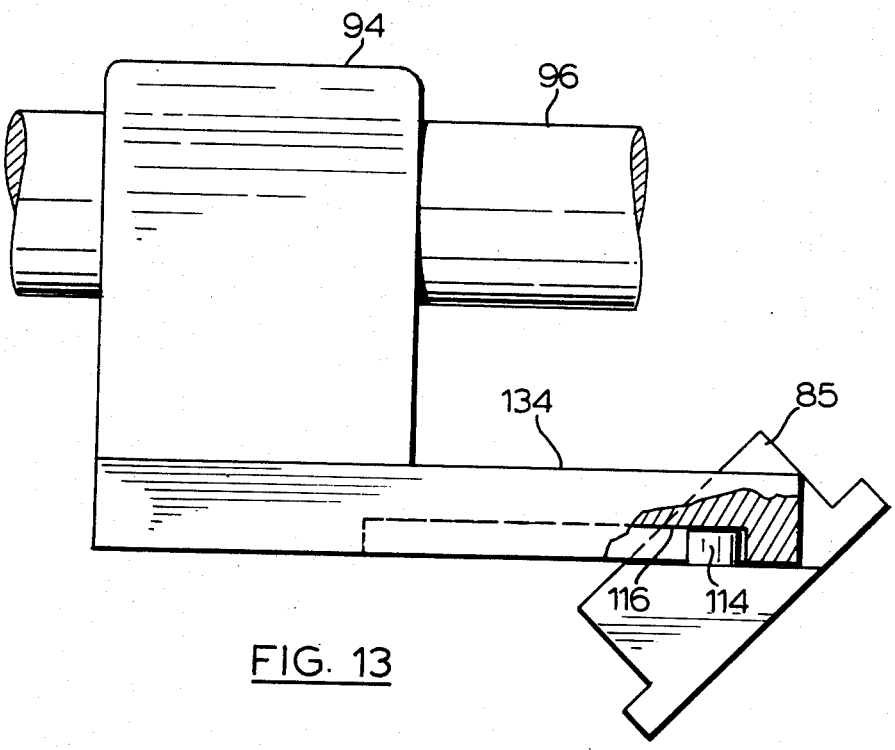
FIG. 13 is a part sectional end view taken in a direction of arrow 13 in FIG. 1.

The backing plates 84 and 85 each is provided with a groove 86 in the facing edges surfaces thereof, which together define a conduit 88 extending through the plate 84 from the orifice 80 when the plates 84 and 85 are in edge-abutting relationship as seen in FIG. 10.

The backing plates 84 and 85 each has a shoulder 90, 91 diverging in width from the abutting edge and defining with the remainder of the plate on inclined surface 92 and 93. The shoulders 90 and 91 adjacent the inner edge of each plate is shaped to support a clip 18 between positions where the plates 84 and 85 are slightly spaced apart from each other and where the plates 84 and 85 abut each other. The shoulders 90 and 91 cooperate to provide a support for a clip 18 in the manner seen in FIGS. 9 and 10.

A mold cavity plate support member 94 is mounted for reciprocal movement on support rods 96 secured to a fixed frame 98, only part of which is shown in FIG. 1. Reciprocal movement of member 94 is actuated by a pneumatically, or otherwise controlled cylinder 100 through piston rod 102 and articulated links 104.

A depression 106 is provided in an elongated block 108 mounted on the member 94 with its open side facing the backing plates 84 to define with the inclined surfaces 92 and 93 a mold cavity 110 which is in fluid flow communication with the bath 12 through passageway 78 and conduit 88.

The depression 106 may be provided directly in member 94, if desired, although it is preferred to form it in the elongated block 108, since, the block 108 may be readily replaced to provide a mold cavity 110 of any desired length, depending on the length of the depression 106 in the individual block 108. The depression 106 is arcuately shaped, complementary to the arcuate shape of the inclined surfaces 92 and 93, to provide an arcuate mold cavity 110 of radius of curvature substantially that of the wheel rim to which the weight is to be applied.

A sensor 112 extends through the member 94 to sense the presence of a clip 18 when the mold cavity 110 is being filled. The importance of this feature will become apparent hereinafter when the operation of the apparatus is discussed.

A cam follower element in the form of a pin, or a pin with a roller element rotatably mounted thereon is provided upstanding from and attached to a flat plate-like member 132 formed integral with each plate 84, 85 at the outer extremity thereof. As seen in the end view of FIG. 13, each pin 114 is positioned in and engages a cam track element in the form of a slot 116 formed in the underside of plate-like members 134, 136 attached to the member 94 to provide a mechanical interconnection between the member 94 and the plates 84, 85.

Figure 8:
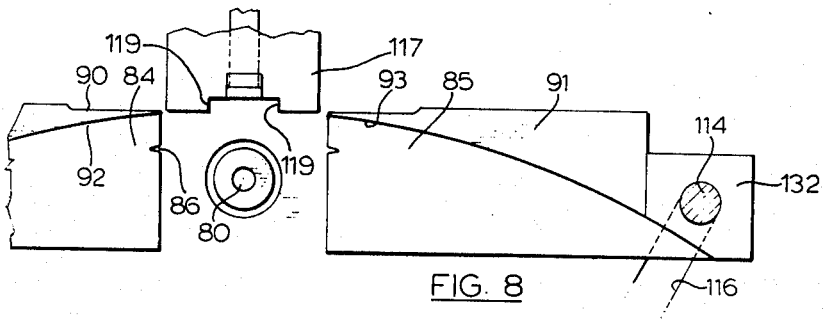
FIG. 8 is an elevational view of the backing plate jaws of theh mold in a first position with the position of a cam pin attached to the remainder of the mold in a cam follower slot superimposed thereon.
Figure 9:
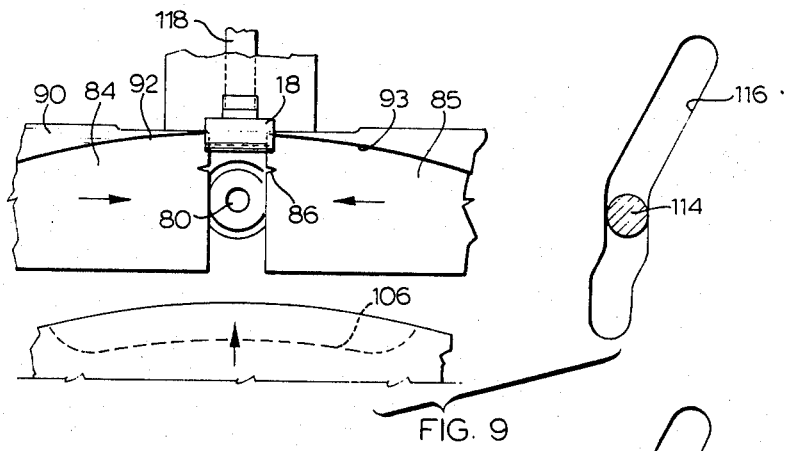
FIG. 9 is an elevational view of the backing plate jaws of the mold in a second position with the corresponding position of the pin in the slot being indicated.

Upon movement of the member 94 forwardly and rearwardly, the slot 116 moves relative to the pin 114 with the pin engaging the walls of the slot, and thereby causing positioning of the plates 84 and 85 with respect to each other and causing the same to assume the open, intermediate and closed positions of FIGS. 8, 9 and 10 respectively, with the appropriate relative location of the slot 116 and the pin 114 being shown therein.

A stationary block member 117 is provided rearward of the plates 84, 85 having recessed slot edges 119 spaced to engage and position the clip 18 laterally when supported by the shoulders 90, 91.

Figure 3:
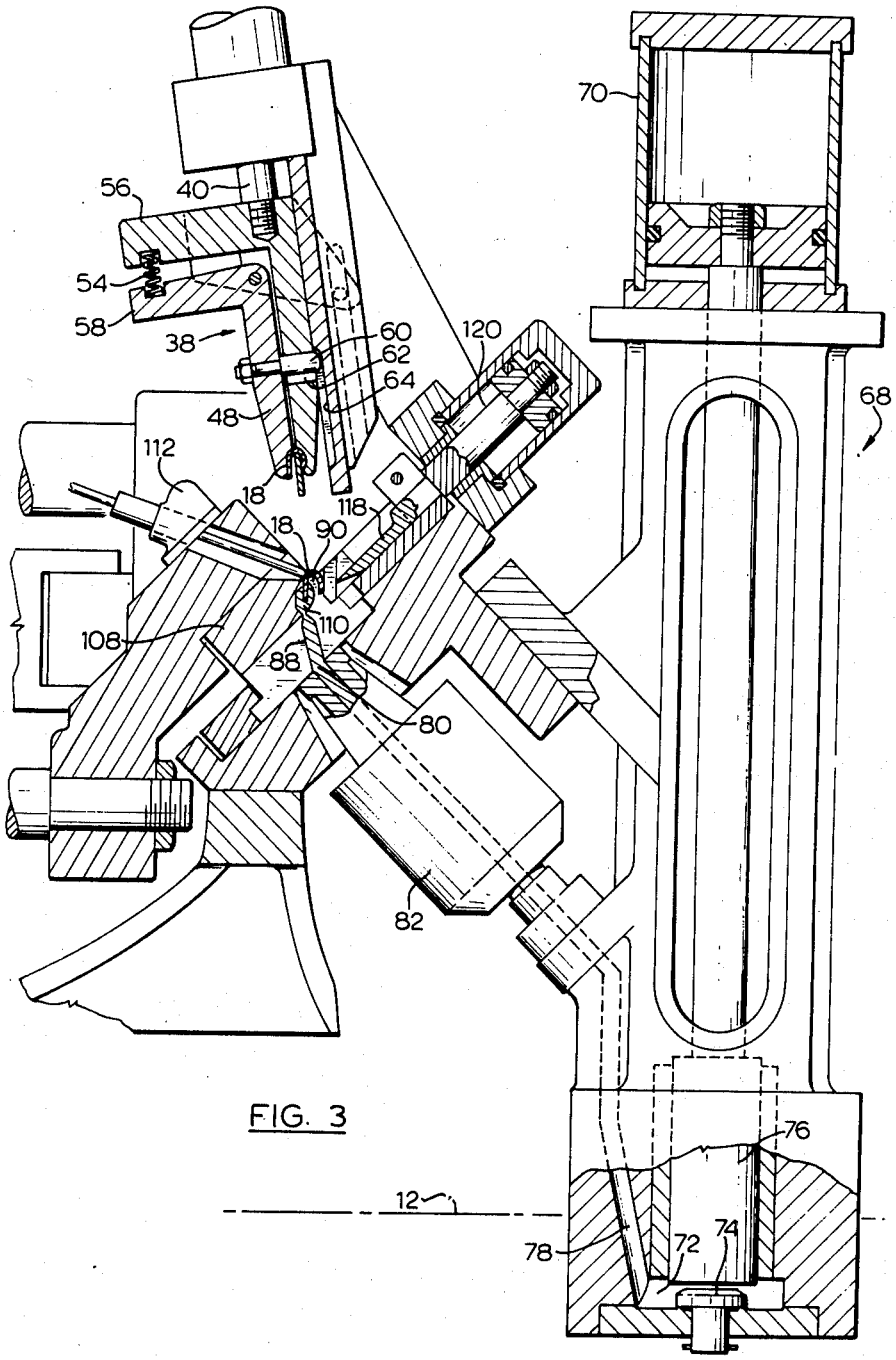
FIG. 3 is a sectional view of the apparatus of FIG. 1 taken along line 3—3 thereof.

A knife element 118 is reciprocable by a pneumatically operated cylinder 120 between a normal retracted position, as illustrated in FIG. 3, and an extended position, as illustrated in FIG. 12, wherein the element 118 extends through a slot 122 formed in the stationary member 117 and beyond the opening of the conduit 88 between the plates 84 and 85.

An ejection chute 124 is positioned below the elements defining the mold cavity 110 to receive finished weights from the apparatus 10 and guide them to a collecting bin or the like.

The apparatus 10 described above with reference to the drawings is capable of forming lead weights 126 of the type shown in FIG. 11, having an elongated curved body 128 in which is embedded a clip 18.

Figure 14:
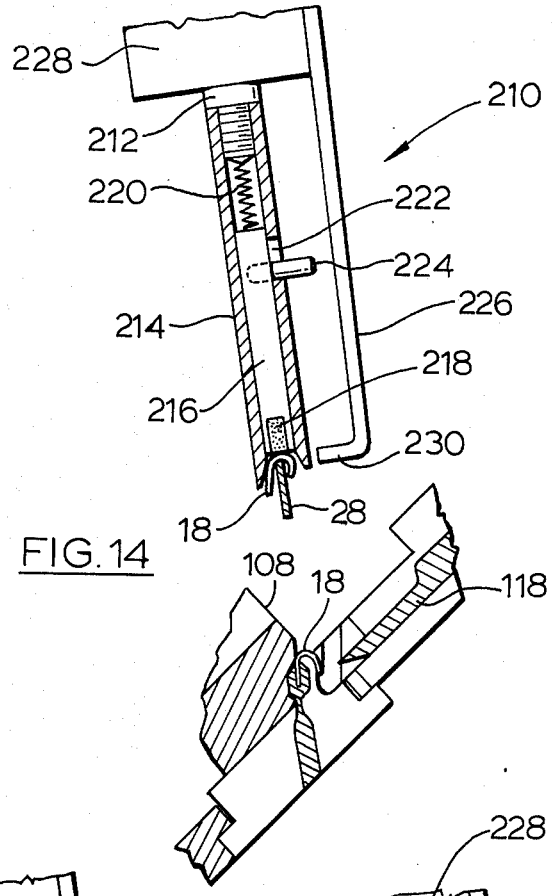
FIGS. 14 to 16 are sectional views of a clip positioner in accordance with a second embodiment of the invention, illustrated in the equivalent positions to those illustrated in FIGS. 3 to 5.
Figure 15:
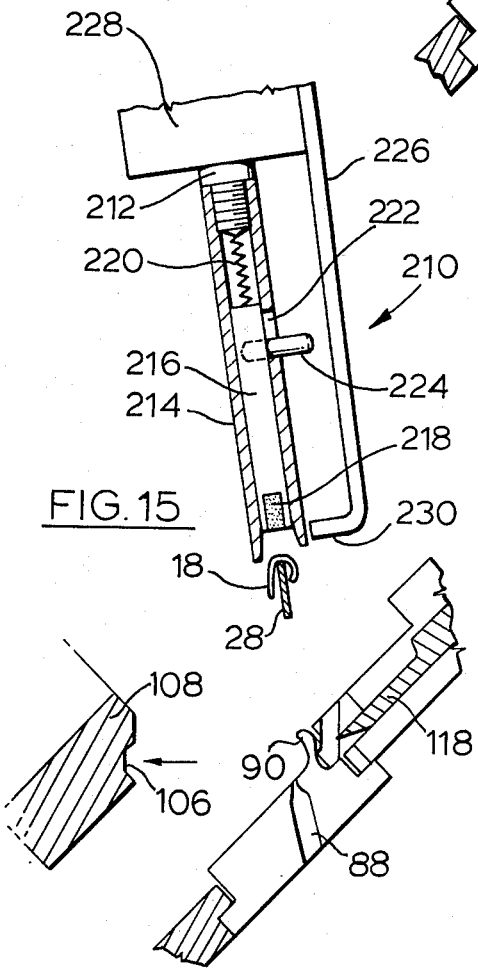
Figure 16:
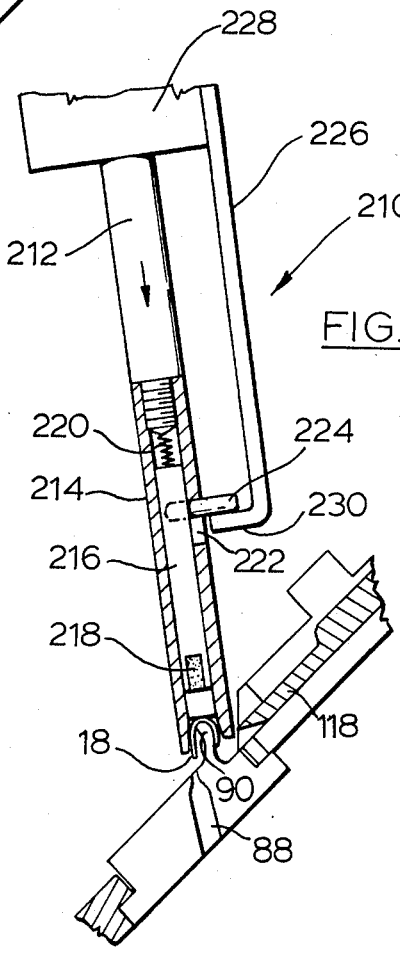

In FIGS. 14 to 16, there is illustrated an alternative type of clip positioner 210 to clip positioner 36 illustrated in FIGS. 1 to 13. Clip positioner 210 includes a reciprocable member 212 actuatable by a pneumatic cylinder, such as cylinder 42, and having a hollow member 214 secured at the lower end thereof. A number 216 is slidably mounted in the hollow member 214 and has a magnet element 218 secured thereto at the lower end thereof. The slidable member 216 is biased downwardly by a compression spring 220 positioned between the top of the slidable member 216 and the reciprocable member 212.

An elongated slot 222 is provided in the wall of the member 214 extending substantially parallel to the axis of the slidable member 216. A projection 224 is secured to the slidable member 216 and projects through the slot 222 for engagement with the walls of the slot 222 at least at the upper and lower extremities thereof to define the upper and lower extremities of movement of the slidable member 216.

A stationary member 226 is mounted to a stationary frame member 228 and has a rod-engaging flange portion 230 at the lower portion thereof for engagement with the projection 224 during a predetermined phase of operation of the clip positioning device 210, as described in more detail below.

While a permanent magnet element 218 is illustrated, an electro-magnet may be used. Where such an electromagnet is used, it may be possible to eliminate the need for the slot 222 and pin 224 and rely solely on the activation and inactivation of the magnet to hold and release the clip 18.

Turning now to the embodiment of FIGS. 17 to 23, where like parts to the embodiment of FIGS. 1 to 13 are used, like reference numerals are employed. In place of the stationary member 117, in this embodiment there are provided a pair of laterally-reciprocable members 310, 312 each having a shoulder 314 formed therein. The shoulders 314 cooperate when the members 310, 312 are closest together to define a clip engaging and locating device, as described in more detail below.

Each of the laterally reciprocable members 310, 312 is integral with a plate member 313, 315 which is mounted to an elongate support and motion transmitting member 316, 318 by bolts 317 and 319. The plate members 313, 315 include an elongate slot (not shown) for allowing limited adjustment of the plate members 313, 315 relative to the support members 316, 318 transverse to the axis thereof.

Each of the support members 316, 318 includes an elongate planar portion 320 integral with a generally rectangular portion 322 inclined to the horizontal.

Each of the support members 316, 318 is slidably mounted to a stationary base member 321 forming part of the support frame for sliding movement longitudinally thereof for moving the laterally-reciprocable members 310, 312 relative to each other. An elongate slot 326 is provided in the rectangular portion of each of the support members 316, 318 and a stationary pin 323 mounted to the base member 321 is positioned in the slot 326. A cover plate 330 is connected to the stationary pin 323 by a bolt 238 to hold the support members 316, 318 to the base member 321 for the reciprocal sliding movement.

Figure 18:
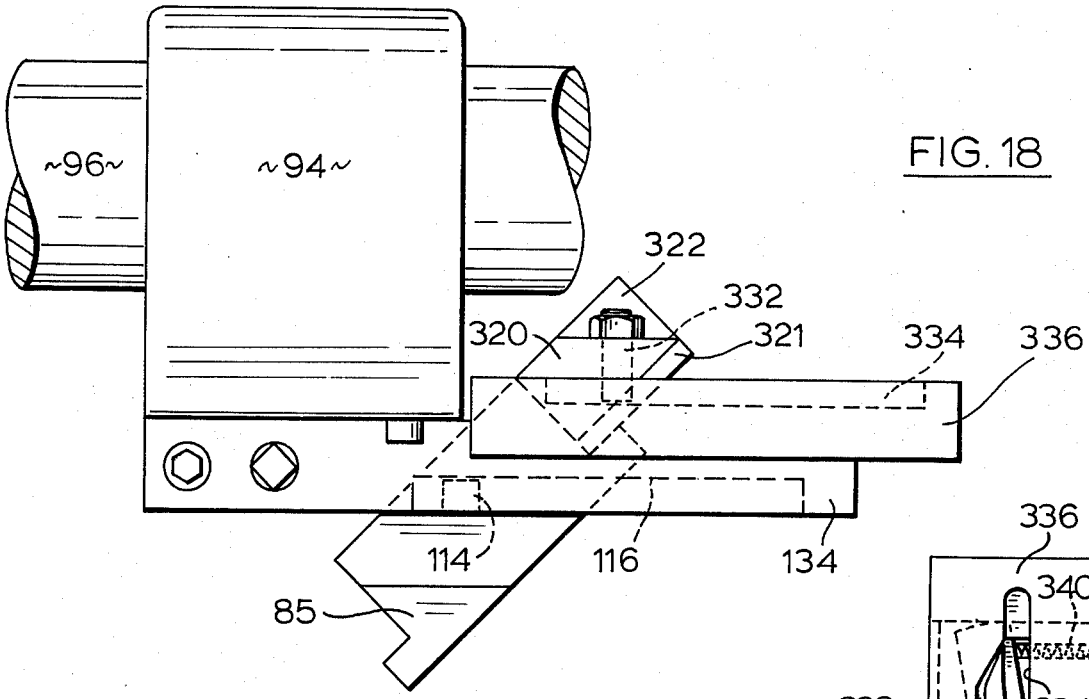
FIG. 18 is an end view of the modification of FIG. 17.

Mounted to each planar portion 320 is a downwardly-projecting pin 332 or a pin having a roller rotatably mounted thereon, constituting a cam follower element extending into a shaped slot 334 constituting a cam element and formed in a block member 336 attached to each of the plate members 134 and 136, as seen in detail in FIG. 18.

The block member 336 is generally hollow and a pin guide element 338 is positioned in the slot 334 to divide the slot into two areas. The pin guide element 338 is biased at its ends in opposite directions by compression spring 340 located inside the block member 336, as seen in FIG. 19.

Figure 19:
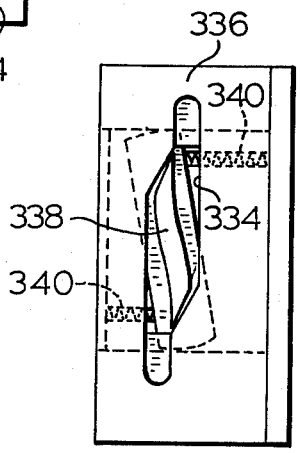
FIG. 19 is an elevational view of a detail of the modification of FIG. 17.
Figure 17:
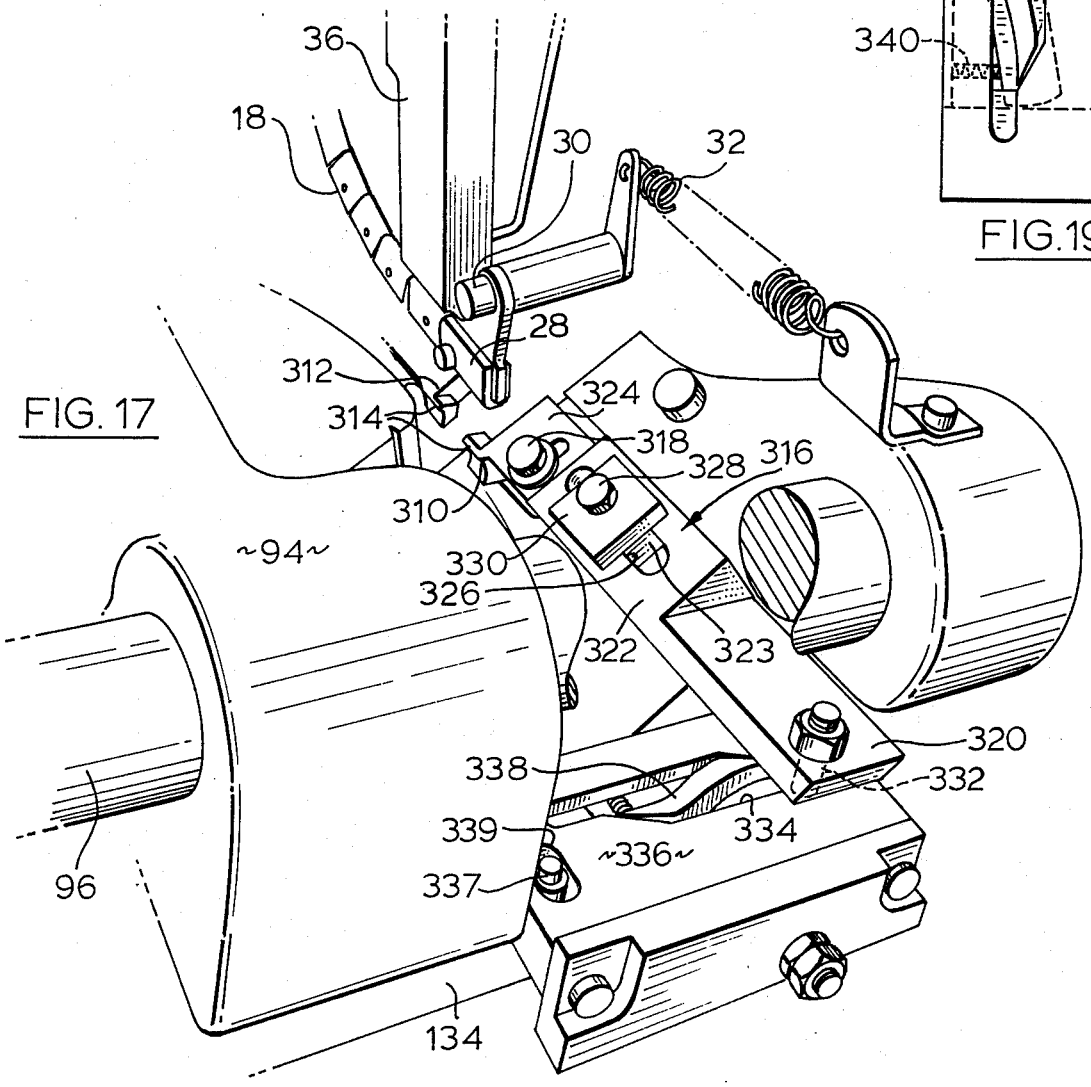
FIG. 17 is perspective view of a portion of a modification of the machine of FIG. 1 in accordance with a third embodiment of the invention.

The pin guide element 338 normally is biased so that its ends rest against inclined walls of the slot 334, as seen in FIG. 19. This arrangement allows the provision of separate cam slots on opposite sides of the element 338 along which the pin 332 may pass from one end of the slot 334 to the other, as described in more detail below, and as illustrated in FIGS. 20 to 23.

The block member 336 is mounted on the plate members 134 and 136 by a bolt 337 passing through an elongate slot 339 extending generally transverse to the block member 336. This slot allows the position of the block member 336 on the plate members 134 and 136 to be varied, so that the distance between the members 310 and 312 at their closest approach may be varied, depending on the size of the clip 18 to be used in the weight. This is in contrast to the embodiment of FIGS. 1 to 13 discussed above wherein, if a different size clip 18 is to be accommodated, the block member 117 must be changed to provide one with differently-spaced shoulders 119.

OPERATION

The cycle through which the apparatus 10 goes to produce the lead weights is controlled by actuation of the appropriate actuation cylinders in properly timed sequance. The timing and actuation may be provided electronically or in any other convenient manner. In this way, the necessity for manual operation is avoided.

Figure 2:
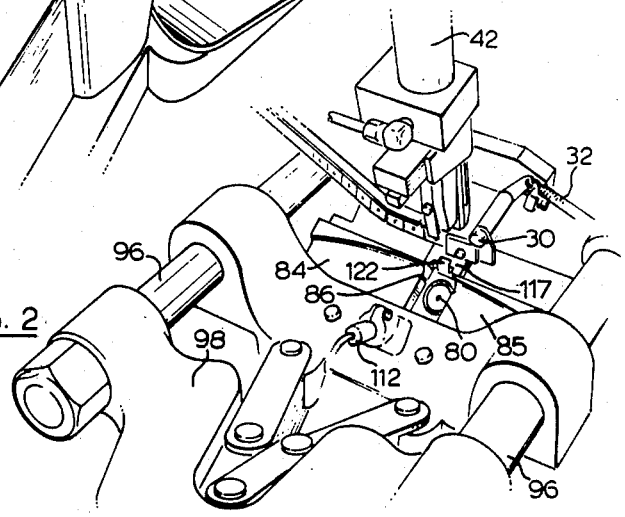
FIG. 2 is a close-up perspective view of a portion of the apparatus of FIG. 1.
Figure 4:
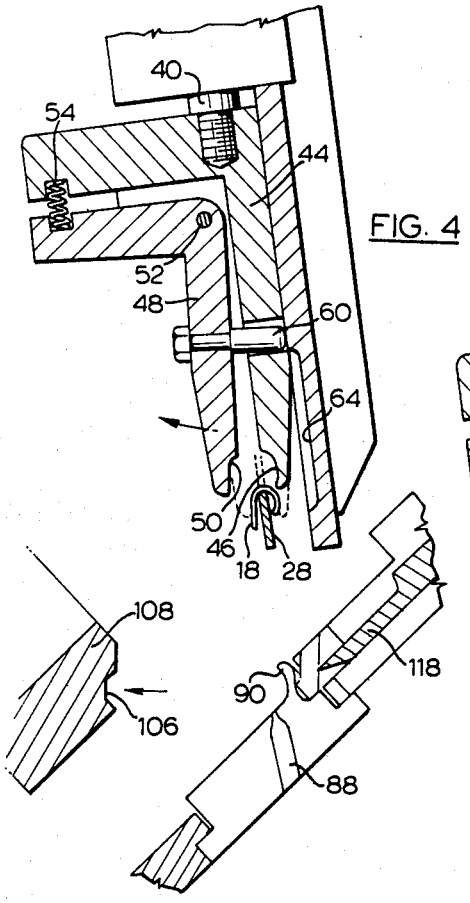
FIG. 4 is a side elevational view of the jaws of the clip-positioning portion of the apparatus of FIG. 1 in a first position.

Referring first to the embodiment of FIGS. 1 to 13, at the commencement of the cycle, a clip 18 is supported by the arm 28 in the position shown in FIG. 6, the member 94 is in its fully retracted position as in FIG. 2 with the pin 114 being positioned in the slot 116 in the position shown in FIG. 8, and the jaws 38 of the clip positioner 36 grip the clip 18 as seen in FIG. 3. During a previous cycle, the jaws 38 moved to their fully retracted position and were open, as seen in FIG. 4. The jaws 38 then moved downwardly to engage and grip the clip 18.

The member 94 slides towards the plates 84 and 85 along the rods 96. During these acts the plates 84 and 85 move towards each other, moving between the position shown in FIG. 8 and that shown in FIG. 9, the movement of the plates 84 and 85 being dictated by the camming action of the pin 114 in the slot 116.

Figure 5:
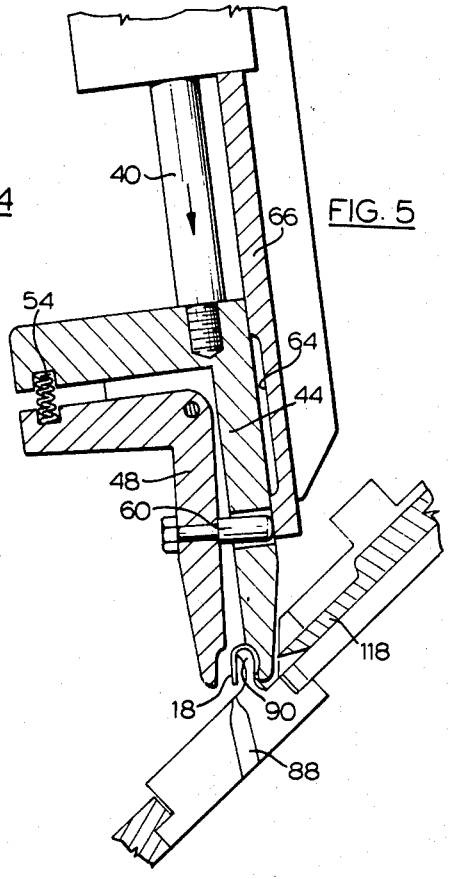
FIG. 5 is a side elevational view of the jaws of the clip-positioning portion of the apparatus of FIG. 1 in a second position.
Figure 7:
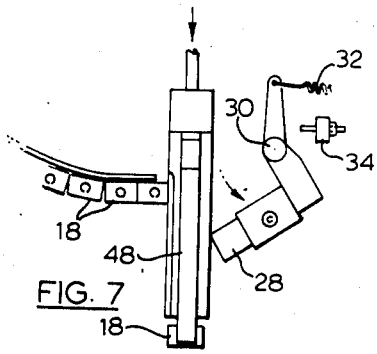
FIG. 7 is an elevational view of the feed clip holder of the apparatus of FIG. 1, when the jaws of the clip positioning portion are moving towards the position shown in FIG. 5.

The jaws 38, gripping therebetween the clip 18, then move downwardly until the clip 18 almost engages the adjacent shoulders 90 and 91 of the plates 84 and 85, at which point the pin 60 reaches the extremity of the groove 64 and the jaws are opened to release the clip 18, as shown in FIG. 5 to allow the clip 18 to engage the shoulders 90 and 91. During this movement, the plates 84 and 85 remain in the same relative position as the pin 114 moves in the straight portion of the slot 116 and the arm 28 is pushed out of the line of movement of the jaws 38 as seen in FIG. 7.

Thereafter, the mold 110 is formed by movement of the plates 84 and 85 to their edge abutting position as seen in FIG. 10, retraction of the jaws 38 leaving the clip 18 positioned on the shoulders 90 and 91 of the plates 84 and 85, and movement of the member 94 so that the block 108 contacts the edge abutting plates 84 and 85 while the pin 114 assumes the position shown in FIG. 10. In the mold-closed position, shown in FIG. 3, the sensor 112 senses the presence or absence of a clip 18.

If a clip 18 is present, as it will be in normal operation, appropriate actuation of the pump 68 causes molten lead to flow through the passageway 78 and the conduit 88 and into the mold cavity 110. The mold usually is water cooled so that the molten lead present in the cavity 110 and the conduit 88 is solidified.

In the absence of a clip 18, such as, where no clips are fed to the arm 28, the pump 68 is not actuated and the parts return to their initial position. Upon resumption of the feed of clips 18, the weight-making procedure recommences. The sensor 112, 112, is important to ensure that the machine does not continue to make lead weights when the supply of clips is exhausted or otherwise defective.

The retraction of the jaws 38 proceeds to the position shown in FIG. 4 i.e., with the jaws 38 open, and allows the arm 28 to resume its original position, so that the next clip 18 of the stream 20 is positioned on the arm 28. When the clip 18 is so positioned, the jaws 38 then move into gripping engagement therewith, as seen in FIG. 3.

After solidifying the lead, the member 98 retracts, along with the plates 84 and 85 which retract to the position shown in FIG. 9. It will be observed at this point that the weight is in the form shown in FIG. 11 with an additional tail 130, shown in phantom outline. It is in this form that prior art manually actuated machines produce lead weights, such weights requiring a further step to remove the tail.

The knife 118 is actuated and cuts the tail 130 from the weight 126, as may be seen in FIG. 12. Upon further retraction of the plates 84 and 85, along with the member 94, the weight 126 is released from the shoulders 90 onto the chute 124 and have discharged from the apparatus. The apparatsu then has resumed its starting position and the cycle is repeated.

When the modified clip positioning device of FIGS. 14 to 16 is used, the sequence of operations with reference to clip positioning is similar to that described above with reference to the embodiment of FIGS. 1 to 13.

Thus, at the commencement of the cycle, a clip is supported by the arm 28 in the position shown in FIG. 6. The member 214 commencing from the position shown in FIG. 15, moves downwardly to engage the clip 18 and hold the same by means of the magnet 218 as illustrated in FIG. 14.

The member 214 with the clip 18 held by the magnet 218 then moves downwardly until the clip 18 almost engages the adjacent shoulders 90 and 91 of the plates 84 and 85, at which point the projection 224 engages the stationary flange 230. Upon continued further downward movement of the member 214, the projection 224 moves in the slot 222 against the force of the compression spring 220. This action releases the magnetic grip on the clip 18 allowing the clip 18 to engage the shoulder 90 and 91, as seen in FIG. 16.

The member 214 then is retracted to the position shown in FIG. 15, allowing the arm 28 to resume its original position, so that the next clip 18 of the stream 20 is positioned on the arm 28. The sequence then is repeated.

Turning now to the embodiment of FIGS. 17 to 23, the operation is substantially as described above in connection with the embodiment of FIGS. 1 to 13, with the exception of the additional features of this embodiment. The sequence of events involved is best understood with reference to FIGS. 20 to 23.

Figure 20:
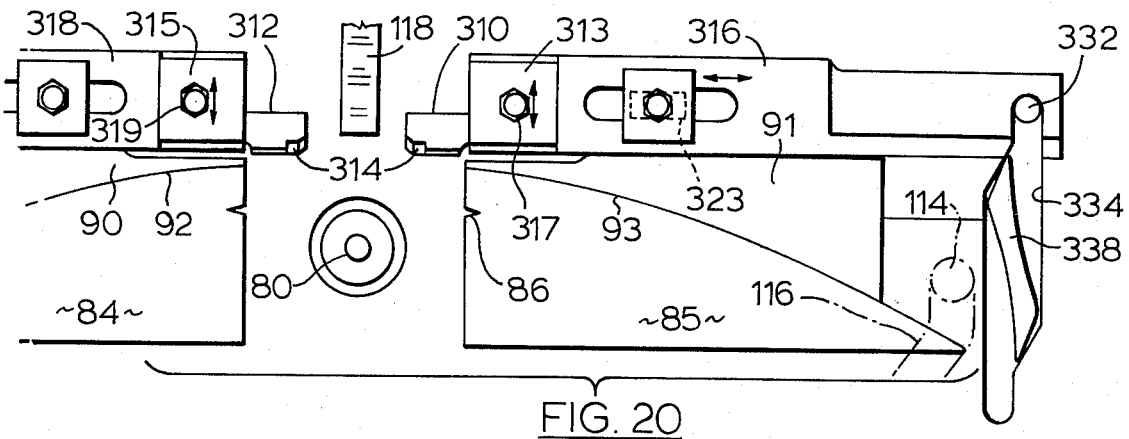
FIGS. 20 to 23 are elevational views of the modification of FIG. 17 illustrating the relative locations of certain members during various phases of operation of the machine.

At the commencement of the cycle, the member 94 is in its fully retracted position, as seen in FIG. 2, with the pin 114 being positioned in the slot 116 and the pin 332 being positioned in the slot 334 in the locations shown in FIG. 20. The jaws 38 of the clip positioner 36 grip the clip 18 as seen in FIG. 3 or the magnet 218 holds the clip 18 as seen in FIG. 14, depending on the type of clip positioner used.

Figure 21:
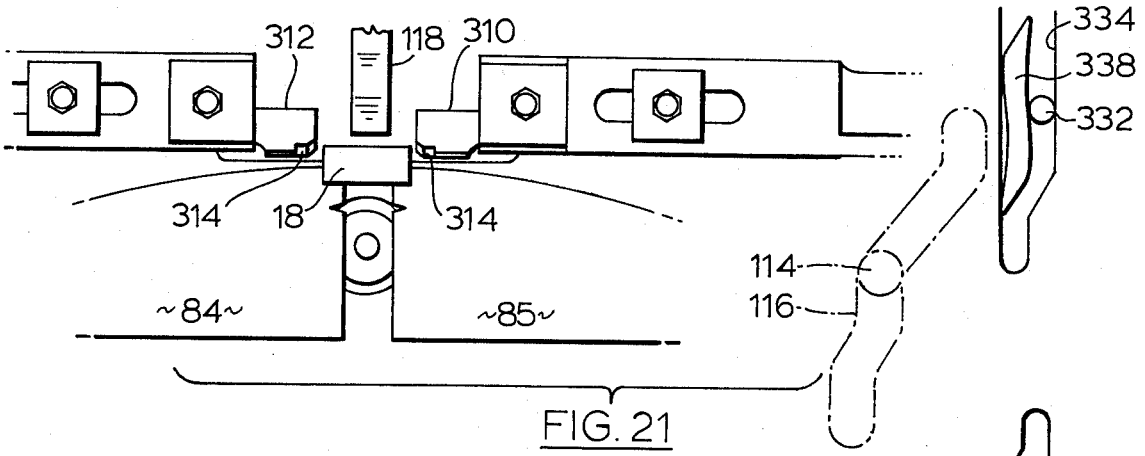

The member 94 slides towards the plates 84 and 85 along the rods 96. During this act the plates 84 and 85 move together by virtue of the movement of the slot 116 relative to the pin 114 in an angularly-shaped portion of the slot 116 to the position shown in FIG. 21. During this period, the members 310 and 312 remain stationary as the slot 334 moves relative to the pin 332 in a straight line motion along one side of the guide member 334 against the biasing of the springs 340, also as seen in FIG. 21.

The jaws 38, gripping therebetween the clip 18, move downwardly until the clip almost engages the adjacent shoulder 90 and 91 of the plates 84 and 85, at which point the pin 60 reaches the extremity of the groove 64 and rises out of the groove to cause opening of the jaws by pivotal movement of the jaw 48 relative to the jaw 44 to allow the clip 18 to engage the shoulders 90 and 91.

Of course, if the clip positioner 210 is used in place of the clip positioner 36, then the sequence of events described above in connection with FIGS. 14 to 16 is carried out in place of the herein described sequence for the clip positioner 36.

During this movement and positioning of the clip 18 on the shoulders 90 and 91, the plates 84 and 85 remain in the same relative position and spaced apart a distance such that the shoulders 90 and 91 can hold the clip 18, as do the members 310 and 312, since, in the first case, the slot 116 has a straight line movement relative to the pin 114 during this period, and, in the second case, the slot 334 is still moving in the same straight line direction.

Figure 22:
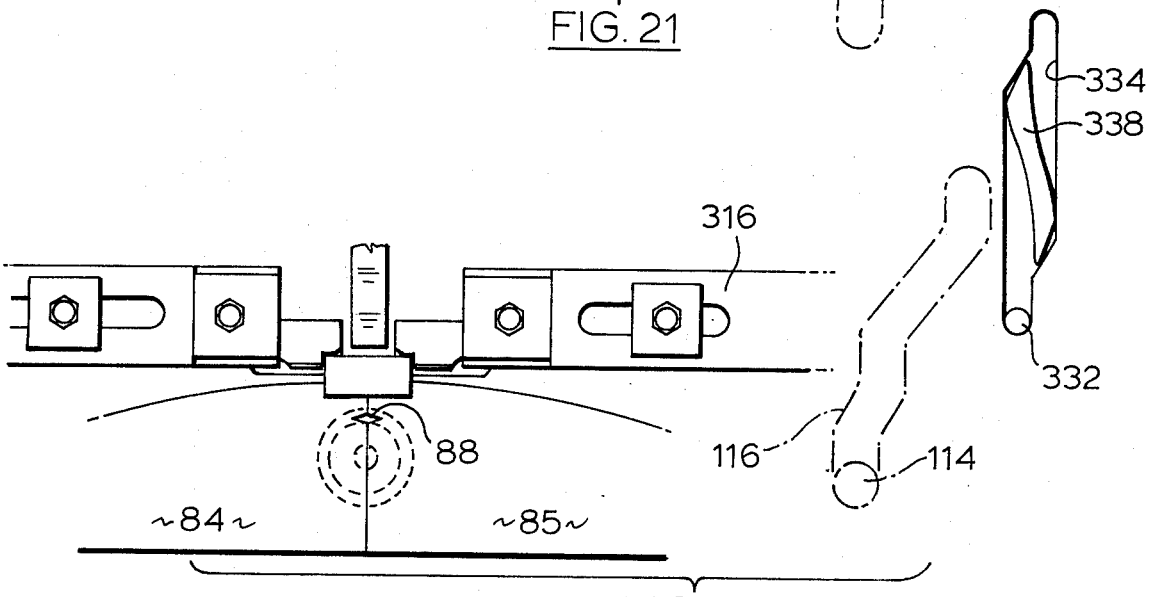

Thereafter, the mold 110 is formed first by movement of the plates 84, 85 to their edge abutting position by movement of an angular portion of the slot 116 relative to the pin 114, followed by final movement of the block 108 into engagement with the jaws 84, 85, while the edge-abutting relationship of the jaws is retained, as seen in FIG. 22. During this period, the members 310 and 312 move towards each other so that the shoulders 314 engage the clip 18 and ensure that it is centrally positioned on the shoulders 90 and 91, by movement of an annular portion of the slot 334 between the wall thereof and the wall of the member 338 relative to the pin 332, followed by further straight line movement, until the position shown in FIG. 22 is reached.

Figure 23:
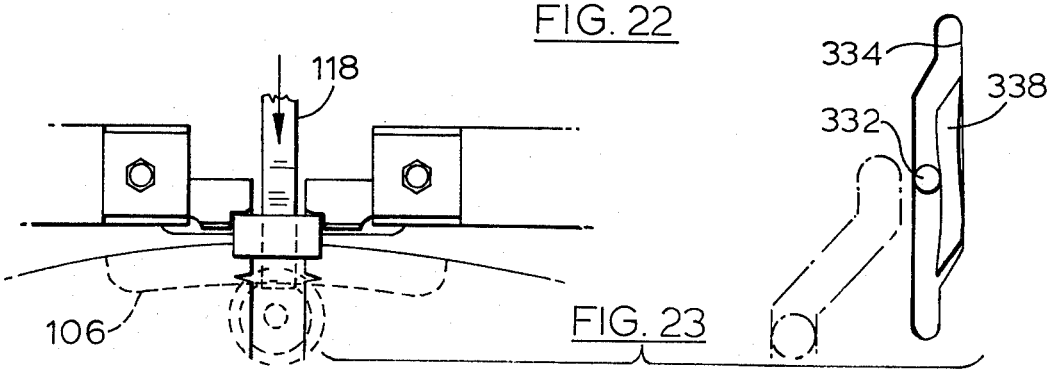

Following filling of the mold cavity 110 and solidifying the lead, the member 98 retracts to the position shown in FIG. 23. At the point, the jaws 84 and 85 are positioned apart a distance such that the clip 18 is retained on the shoulders 90 and 91. At the same time, the members 310 and 312 retain their grip on the clip 18, providing stability to the weight during cutting off of the tail, in contrast to the device of FIGS. 1 to 13 using the stationary block 117. The grip between the members 310 and 312 is retained since the slot 334 again moves in a straight line path relative to the pin 332 but on the opposite side of the guide member 332 from the movement illustrated in FIGS. 20 and 21.

Following actuation of the knife and cutting of the tail 130 from the weight 126, the plates 84 and 85 retract further releasing the weight 126 from the shoulders 90 and 91 after which the members 310 and 312 retract releasing the weight 126 into the chute 124. The retraction of the plates 84, 85 is caused by movement of an angular portion of the slot 116 relative to the pin 114, while the retraction of the members 310, 312 is caused by angular movement of the slot 334 relative to the pin 332. The apparatus resumes its starting position as shown in FIG. 20 and the cycle is repeated.

SUMMARY

It will be seen, therefore, that the apparatus of the present invention is able to produce lead weights which may be used directly without the prior art necessity of a separate operation to remove the tails. Further, the apparatus may operate substantially continuously without supervision or manual operation, other than to ensure an adequate supply of clips and molten lead.

Modifications are possible within the scope of the present invention.

What I claim is:

1. A clip positioning device for a lead weight-making machine comprising a first stationary member;

a second member reciprocably movable relative to said first stationary member between a first position adjacent said first stationary member and a second position remote from said first stationary member through a predetermined intermediate position;

means associated with said first stationary member operably connected to said second member for reciprocably moving the same between said first and second positions;

said second member including a hollow elongate outer shell portion open at the end thereof remote from said first stationary member and magnetic means mounted within said shell portion;

at least part of said magnetic means normally being located adjacent said open end of said outer shell protion in a clip holding position, said magnetic means being movable within said shell portion in the direction of elongation thereof away from said open end and out of said clip holding position;

means normally biasing said magnetic means to said clip holding position;

stop means mounted on said first stationary member; and stop engaging means associated with said magnetic means and positioned to engage said stop means when said second member is located at and between said intermediate and second positions;

said stop engaging means and said second member being constructed to move said magnetic means inwardly of said outer shell portion against said biasing when said second member is located at and between said intermediate and second positions.

2. The device of claim 1 wherein said magnetic means is mounted at one end of a reciprocable member slidably mounted in said outer shell portion.

3. The device of claim 2 wherein said outer shell has an elongate slot formed therein extending generally in the direction of elongation of said second member, said stop engaging means comprises a pin-like element mounted to said reciprocable member and extending through said slot exteriorally of said outer shell portion, and said stop means comprises a flange element mounted to said first stationary member and positioned to engage said pin-like element to move said pin-like element longitudinally of the slot when the second member moves between said intermediate and said second positions and to out of engagement with said pin-like element when the second member moves between said intermediate and first positions.

4. The device of claim 3 wherein said means normally biasing said magnetic means towards said clip holding position is compression spring means located internally of said outer shell portion biasingly positioned between the end of said reciprocable member remote from said magnetic means and an internal wall of said outer shell portion opposite to said open end, and said magnetic means is prevented from biased movement beyond said clip holding position outwardly of said open end by engagement of said pin-like element with the extremity of said slot closest to said open end.

5. A clip positioning device, comprising:

a stationary member, jaw means substantially vertically reciprocably movable relative to said stationary member between an upper extremity adjacent said stationary member and a lower extremity remote from said stationary member, means associated with said stationary member operably connected to said jaw means for reciprocably moving the same between said upper and lower extremities, said jaw means including first and second jaw elements pivotally connected to each other solely for pivotal movement of one of said jaw elements relative to the other and normally biased to a closed position for gripping a clip therebetween, said first jaw element being mounted to said means for reciprocably moving and having a generally L-shaped cross-section including a downwardly-extending arm and a laterally-extending arm, said second jaw element having a generally L-shaped cross-section including a downwardly-extending arm and a laterally-extending arm and being connected to said first jaw element for pivotal movement relative thereto at the apex of said L-shaped cross-section thereof, spring means positioned in biasing relationship between the laterally-extending arms of said first and second jaw elements, cooperating recesses formed in the opposed faces of the downwardly-extending arms at the lower extremity thereof defining a clip-gripping recess, a stationary cam element mounted on said stationary member and including a substantially vertically-extending channel portion and raised portions at each vertical extremity of said channel portion, and a cam follower element associated with said jaw means engaging said cam element with said cam follower element being positioned in said channel portion when said jaws are in said closed position and said cam follower element being positioned in engagement with one of said raised portions when said jaw means is opened by said pivotal movement of one of said jaw elements relative to the other jaw element against said biasing to a non-clip-gripping position.

6. The device of claim 5, wherein said stationary member includes a downwardly-projecting flange element extending generally parallel to the path of movement of said jaw means, and said cam element forms part of said flange element, and including an opening in said first jaw element and a projection mounted to said second jaw element extending through said opening into engagement with said cam element, said projection constituting said cam follower element.

7. An apparatus for forming lead weights for the balancing of automobile wheels, which comprises:

container means for holding a bath of molten lead;

a lead weight-forming mold cavity located above said container means and situated at a molding station;

liquid lead feed means extending between said bath and said mold cavity for conveying molten lead from said bath to said mold cavity;

said mold cavity being defined by first and second plates situated in edge-abutting relationship and a block located in face-abutting relationship with said first and second plates, said block having a depression formed in the face thereof abutting said first and second plates;

said first and second plates being mounted for relative movement between a first stationary position in which the plates have said edge-abutting relationship and a second stationary position in which the plates are remote from said edge-abutting relationship;

said block being mounted on a carrier member for reciprocal movement in a substantially horizontal plane between a first position wherein said block is located in said face-abutting relationship with said first and second plates and a second position horizontally remote from said first position;

the abutting edges of each of said first and second plates having a groove formed therein extending the depth of the plates, the grooves cooperating to define a lead conveying passage constituting part of said liquid lead feed means when said first and second plates are in said edge-abutting relationship;

a clip holding station located above said molding station;

said holding station comprising an arm biased to a normally horizontal position adapted to receive and support a clip and pivoted at one end thereof for downward movement against said biasing under the application of a downwardly-directed bias-overcoming force to said arm;

weight retaining clip feed means located adjacent said holding station to feed individual magnetic forceholdable clips from a source thereof to said holding station;

clip positioning means located above said holding station for moving individual clips from said holding station to said molding station;

said clip positioning means including magnetic means substantially vertically reciprocable between an upper extremity positioned above said arm and a lower extremity at said molding station, during movement from said upper extremity to said lower extremity said magnetic means biasing said arm to pivot said arm out of the path of said positioning means, said clip positioning means further including means for inactivating said magnetic means relative to said clip means at said molding station to release and position said clip means at said molding station;

clip supporting means on said first and second backing plates for supporting a clip at said molding station with part thereof extending into said mold cavity, when said first and second plates are in said edge-abutting position or spaced apart from each other up to a predetermined position from each other, and knife means located adjacent said molding station and movable between a first inactive position and a second position wherein said knife means extends over the orifice to said lead conveying passage, whereby any lead solidified in said passage may be detached from a lead weight formed in said mold caavity.

8. The apparatus of claim 7 wherein said clip positioner further includes a first stationary member; a second member supporting said magnetic means and reciprocably movable relative to said first stationary member between a first upper position adjacent said first stationary member and corresponding to said upper extremity and a second lower position remote from said first stationary member and corresponding to said lower extremity through a predetermined position; means associated with the first stationary member operably connected to said second member for reciprocably moving the same between said first and second positions; said second member including a hollow elongate outer shell portion open at the end thereof remote from said first stationary member, said magnetic means mounted in said shell portion with at least part thereof normally being located adjacent said open end of said outer shell portion in a clip holding position; means normally biasing said magnetic means to said clip holding position; stop means mounted on said first stationary member, and stop engaging means associated with said magnetic means and positioned to engage said stop means when said second member is located at and between said intermediate and second positions achieving said moving of said magnetic means out of holding engagement with said clip means.

9. The apparatus of claim 8, wherein said magnetic means is mounted at one end of a reciprocable member slidably mounted in said outer shell portion.

10. The apparatus of claim 9, wherein said outer shell has an elongate slot formed therein extending generally in the direction of elongation of said second member, said stop engaging means comprises a pin-like element mounted to said reciprocable member and extending through said slot exteriorally of said outer shell portion, and said stop means comprises a flange element mounted to said first stationary member and positioned to engage said pin-like element to move said pin-like element longitudinally of the slot when the second member moves between said intermediate and said second positions and to be out of engagement with said pin-like element when the second member moves between said intermediate and first positions.

11. The apparatus of claim 10, wherein said means normally biasing said magnetic means towards siad clip holding position is compression spring means located internally of said outer shell portion biasingly positioned between the end of said reciprocable member remote from said magnetic means and an internal wall of said outer shell portion opposite to said open end, and said magnetic means is prevented from biased movement beyond said clip holding position outwardly of said open end by engagement of said pin-like element with the extremity of said slot closest to said open end.

12. The apparatus of claim 7, wherein said first and second plates are mounted for relative movement between said first and second stationary positions through an intermediate stationary position corresponding to said predetermined spacing of said first and second plates.

13. The apparatus of claim 12, including first mechanical interconnecting means operably connecting said carrier member and said first and second plates for phased movement of said carrier member and said first and second plates between said first and second positions thereof for locating said carrier member at its first position when said first and second plates are located in their first position and at its second position when said first and second plates are located in their second position, said first mechanical interconnecting means comprising first and second elongate cam track elements associated with one of said carrier member and said first and second plates, first and second cam follower elements mounted respectively on the other of said carrier member and said first and second plates and each extending into engagement with one of said cam track elements for control of the position of said first and second plates relative to each other according to the positioning of said cam follower elements along the length of said cam track elements, each of said cam track elements having first and second track portions in which the respective cam follower element moves to cause displacement of said first and second plates relative to each other during predetermined phases of movement of said carrier member between said first and second positions and an intermediate track portion between said first and second track portions to cause holding of each first and second plates at said intermediate stationary position thereof during the phase of movement of said carrier member intermediate said predetermined phases of movement thereof, and first mechanical interconnection being arranged to position said first and second plates to support a clip at said molding station at both said first and intermediate positions thereof but not at said second position thereof.

14. The apparatus of claim 7 wherein said liquid lead feed means comprises pump means and conduit means extending from the outlet of said pump means to said mold cavity.

15. The apparatus of claim 7 wherein said first and second plates each include a shoulder raised from the surface of the plate and increasing in width from the abutting edge to the opposite edge, said shoulder defining an incline with the surface of the plate which is curved across the face of the plate, and the depression in the block is curved across the abutting surface, the inclines of said plates coinciding with the depression in the block to provide a curved mold cavity.

16. The apparatus of claim 15 wherein said shoulders are shaped adjacent said abutting edge to provide said clip supporting means.

17. The apparatus of claim 7 wherein said knife means comprises a reciprocable knife blade movable in the plane of said plates.

18. The apparatus of claim 7 including clip locating means situated at said molding station for engagment of the lateral extremities of a clip situated on said clip supporting means, said clip locating means including first and second clip engaging elements movable towards and away from each other adjacent said first and second plate means between a first position wherein said first and second clip engaging elements are spaced apart a distance equal to the width of said clip for engagement of a clip positioned therebetween and a second position wherein said first and second clip engaging elements are spaced apart a distance greater than said width of said clip, second mechanical interconnecting means operably connecting said carrier member and said first and second clip engaging elements for phased movement of said carrier member and first and second clip engaging elements between said first and second positions thereof for locating said carrier member at its first position when said first and seecond clip engaging elements are located in their second position, at its second position when said first and second clip engaging elements are located in their first position and for maintaining said first and second clip engaging elements at their first position during movement of said carrier member from said second position thereof and movement of said first and second plates from said edgeabutting relationship to said intermediate stationary position, said second mechanical interconnecting means comprising third and fourth elongate cam track elements associated with one of said carrier member and said first and second clip engaging elements, third and fourth cam follower elements mounted respectively on the other of carrier member and said first and second clip engaging elements and each extending into engagement with one of said third and fourth cam track elements for control of the position of said first and second clip engaging elements relative to each other according to the positioning of said third and fourth cam follower elements along the length of said third and fourth cam track elements, each of said third and fourth cam track elements including first and second cam track portions in which the respective cam follower element moves to cause displacement of said first and second grip positioning elements relative to one another between said first and second positions thereof during predetermined phases of movement of said carrier member between said second and first positions respectively and first and second intermediate track portions between said first and second track portions respectively in which the cam follower element moves to cause holding of said first and second clip engaging elements either at said first position or at said second position during phases of movement of said carrier member intermediate said predetermined phases of movement thereof.

19. An apparatus for forming lead weights for the balancing of automobile wheels, which comprises:

container means for holding a bath of molten lead;

a lead weight-forming mold cavity located above said container means and situated at a molding station;

liquid lead feed means extending between said bath and said mold cavity for conveying molten lead from said bath to said mold cavity;

said mold cavity being defined by first and second plates situated in edge-abutting relationship and a block located in face-abutting relationship with said first and second plates, said block having a depression formed in the face thereof abutting said first and second plates;

said first and second plates being mounted for relative movement between a first stationary position in which the plates have said edge-abutting relationship and a second stationary position in which the plates are remote from said edge-abutting relationship;

said block being mounted on a carrier member for reciprocal movement in a substantially horizontal plane between a first position wherein said block is located in said face-abutting relationship with said first and second plates and a second position horizontally remote from said first position;

the abutting edges of each of said first and second plates having a groove formed therein extending the depth of the plates, the grooves cooperating to define a lead conveying passage constituting part of said liquid lead feed means when said first and second plates are in said edge-abutting relationship;

a holding station located above said molding station;

weight-retaining clip feed means located adjacent said holding station to feed individual clips from a source thereof to said holding station;

clip positioning means located above said holding station for moving said individual clips from said holding station to said molding station;

clip supporting means on said first and second backing plates for supporting a clip at said molding station with part thereof extending into said mold cavity, when said first and second plates are in said edge-abutting position or spaced apart from each other up to a predetermined position from each other, knife means located adjacent said molding station and movable between a first inactive position and a second position wherein said knife means extends over the orifice to said lead conveying passage, whereby any lead solidified in said passage may be detached from a lead weight formed in said mold cavity, clip locating means situated at said molding station for engagement of the lateral extremities of a clip situated on said clip supporting means, said clip locating means including first and second clip engaging elements movable towards and away from each other adjacent said first and second plate means between a first position wherein said first and second clip engaging elements are spaced apart a distance equal to the width of said clip for engagement of a clip positioned therebetween and a second position wherein said first and second clip engaging elements are spaced apart a distance greater than said width of said clip, and first mechanical interconnecting means operably connecting said carrier member and said first and second clip engaging elements for phased movement of said carrier member and first and second clip engaging elements between said first and second positions thereof for locating said carrier member at its first position when said first and second clip engaging elements are located in their second position, at its second position when said first and second clip engaging elements are located in their first position and for maintaining said first and second clip engaging elements at their first position during movement of said carrier member from said second position thereof and movement of said first and second plates from said edge-abutting relationship to said intermediate stationary position, said first mechanical interconnecting means comprising first and second elongate cam track elements associated with one of said carrier member and said first and second clip engaging elements, first and second cam follower elements mounted respectively on the other of said carrier member and said first and second clip engaging elements and each extending into engagement with one of said cam track elements for control of the position of said first and second clip engaging elements relative to each other according to the positioning of said cam follower elements along the length of said cam track elements, each of said cam track elements including first and second cam track portions in which the respective cam follower element moves to cause displacement of said first and second grip positioning elements relative to one another between said first and second positions thereof during predetermined phases of movement of said carrier member between said second and first positions respectively and first and second intermediate track portions between said first and second track portions respectively in which the cam follower element moves to cause holding of said first and second clip engaging elements either at said first position or at said second position during phases of movement of said carrier member intermediate said predetermined phases of movement thereof.

20. The apparatus of claim 19 including second mechanical interconnecting means operably connecting said carrier member and said first and second plates for phased movement of said carrier member and said first and second plates between said first and second positions thereof for locating said carrier member at its first position when said first and second plates are located in their first position and at its second position when said first and second plates are located in their second position, said second mechanical interconnecting means comprising third and fourth elongate cam track elements associated with one of said carrier member and said first and second plates, third and fourth cam follower elements mounted respectively on the other of said carrier member and said first and second plates and each extending into engagement with one of said third and fourth cam track elements for control of the position of said first and second plates relative to each other according to the positioning of said third and fourth cam follower elements along the length of said third and fourth cam track elements, each of said third and fourth cam track elements having first and second track portions in which the respective cam follower element moves to cause displacement of said first and second plates relative to each other during predetermined phases of movement of said carrier member between said first and second positions and an intermediate track portion between said first and second track portions to cause holding of said first and second plates at said intermediate stationary position thereof during the phase of movement of said carrier member intermediate said predetermined phases of movement thereof.

said second mechanical interconnection being arranged to position said first and second plates to support a clip at said molding station at both said first and intermediate positions thereof but not at said second position thereof.

21. The apparatus of claim 19 wherein said holding station comprises an arm biased to a normally horizontal position, adpated to receive and support a clip and pivoted for downward movement against said biasing under the application of a downwardly-directed bias-overcoming force to said arm.

22. The apparatus of claim 21 wherein said clip positioning means comprises jaw means substantially vertically reciprocable between an upper extremity positioned above said arm and a lower extremity at said molding station, during movement from said upper extremity to said lower extremity, said jaw means biasing said arm to pivot said arm out of the path of said jaw means; said jaw means including first and second jaw elements pivotally connected to each other solely for pivotal movement of one of said jaw elements relative to the other and normally biased to a closed position for gripping a clip therebetween, said clip positioning means further comprising a stationary cam element including a substantially vertically-extending channel portion and raised portions at each vertical extremity of said channel portion, said jaw means including a cam follower element engaging said cam element with said cam follower element being positioned in said channel portion when said jaws are in said closed position and said cam follower element being positioned in engagement with one of said raised portions when said jaw means is opened by said pivotal movement of one of said jaw elements relative to the other jaw element against biasing to a non-clip-gripping position; said cam element, said cam follower element and said jaw means being arranged so that said jaw means is openable at its upper extremity and in its movement downwardly to said holding station; said jaw means is closable at said holding station to grip a clip positioned thereat and in its movement downwardly to said molding station and said jaw means is openable at its vertically lower extremity to release said grip on said clip and position the same at said molding station.

23. The apparatus of claim 19 wherein said first and second plates each include a shoulder raised from the surface of the plate and increasing in width from the abutting edge to the opposite edge, said shoulder defining an incline with the surface of the plate which is curved across the face of the plate, and the depression in the block is curved across the abutting surface, the inclines of said plates coinciding with the depression in the block to provide a curved mold cavity.

24. The apparatus of claim 23 wherein said shoulders are shaped adjacent said abutting edge to provide said clip supporting means.

25. The apparatus of claim 19 wherein said knife means comprises a reciprocable knife blade movable in the plane of said plate.

26. The apparatus of claim 19 wherein said first and second cam follower elements are pins associated one with each of said first and second clip positioning elements and extending downwardly into said first and second cam track elements mounted on said carrier member, and each of said first and second cam track elements includes a laterally displaceable member defining one wall of said cam track portions, with the member defining the left hand wall of the first intermediate track portion and the first track portion and the right hand wall of the second intermediate cam track portion and the second cam track portion.

27. The apparatus of claim 26 wherein said laterally displaceable member is normally biased into engagement with said first and second track portions and is movable to define said wall upon action of movement of the respective intermediate track portions relative to the first and second cam follower element.

* * * * *